US012623113B2

(12) United States Patent
Kinney

(10) Patent No.: US 12,623,113 B2
(45) Date of Patent: May 12, 2026

(54) LOCKING COLLAR FOR EXERCISE BAR WITH DYNAMICALLY ROTATING HAND GRIPS

(71) Applicant: Resistance in Rotation Corporation, Peru, IN (US)

(72) Inventor: Joseph G. Kinney, Kokomo, IN (US)

(73) Assignee: Resistance in Rotation Corporation, Peru, IN (US)

( * ) Notice: Subject to any disclaimer, the term of this patent is extended or adjusted under 35 U.S.C. 154(b) by 138 days.

(21) Appl. No.: 18/768,785

(22) Filed: Jul. 10, 2024

(65) Prior Publication Data

US 2025/0018242 A1 Jan. 16, 2025

Related U.S. Application Data

(60) Provisional application No. 63/512,717, filed on Jul. 10, 2023.

(51) Int. Cl.
*A63B 21/00* (2006.01)
*A63B 21/072* (2006.01)

(52) U.S. Cl.
CPC ..... *A63B 21/4035* (2015.10); *A63B 21/0724* (2013.01)

(58) Field of Classification Search
CPC ..... A63B 21/4035; A63B 21/0724; A63B 21/0728
See application file for complete search history.

(56) References Cited

U.S. PATENT DOCUMENTS

| | | | | |
|---|---|---|---|---|
| 4,690,400 | A * | 9/1987 | Metz | A63B 21/0724 482/106 |
| 5,024,434 | A * | 6/1991 | Smith | A63B 21/0728 482/106 |
| 5,080,349 | A * | 1/1992 | Vittone | A63B 23/14 482/106 |
| 5,211,616 | A * | 5/1993 | Riley, Jr. | A63B 21/072 482/106 |
| 6,022,300 | A * | 2/2000 | Hightower | A63B 21/0728 482/106 |
| 7,862,486 | B1 * | 1/2011 | Watson | A63B 21/4017 482/106 |
| 10,695,604 | B2 * | 6/2020 | Porterfield | A63B 21/4049 |
| 10,888,731 | B2 * | 1/2021 | Olmstead | A63B 21/0724 |
| 10,960,254 | B2 * | 3/2021 | Hurlbut | A63B 23/03508 |
| 11,117,013 | B1 * | 9/2021 | Davies | A63B 21/0728 |

(Continued)

*Primary Examiner* — Andrew S Lo
(74) *Attorney, Agent, or Firm* — Maginot, Moore & Beck, LLP

(57) ABSTRACT

An exercise bar assembly includes a pair of hand grip assemblies, each with a corresponding plate bar assembly to support a weight. The hand grip assemblies are connected to each other by a center bar assembly that allows the user to select a particular length of center bar assembly for a particular spacing of the hand grip assemblies. The center bar assembly is engageable to each hand grip assembly and locked in place using a rotatable retaining washer that is rotatable between one position in which the center bar assembly can be connected to a hand grip assembly, and a second position in which the center bar assembly cannot be removed from the hand grip assembly. A locking mechanism arrangement is provided that prevents rotation of the retaining washer away from the second position.

10 Claims, 6 Drawing Sheets

(56) References Cited

U.S. PATENT DOCUMENTS

| | | | | |
|---|---|---|---|---|
| 11,504,572 | B2 * | 11/2022 | Kinney | A63B 21/0557 |
| 2005/0202942 | A1 * | 9/2005 | De Lano | A63B 21/0724<br>482/106 |
| 2008/0176723 | A1 * | 7/2008 | Johnson | A63B 21/0724<br>482/106 |
| 2019/0015696 | A1 * | 1/2019 | Porterfield | A63B 21/4049 |
| 2020/0289870 | A1 * | 9/2020 | Olmstead | A63B 23/03525 |
| 2022/0273979 | A1 * | 9/2022 | Kinney | A63B 21/4035 |
| 2022/0273980 | A1 * | 9/2022 | Kinney | A63B 21/4035 |
| 2024/0316390 | A1 * | 9/2024 | Yazdanshenas | A63B 21/0724 |
| 2024/0350855 | A1 * | 10/2024 | Yazdanshenas | A63B 21/0728 |

* cited by examiner

LOCKING COLLAR FOR EXERCISE BAR WITH DYNAMICALLY ROTATING HAND GRIPS

PRIORITY CLAIM

This application is a utility filing from and claims priority to U.S. provisional application No. 63/512,717, filed on Jul. 10, 2024, the entire disclosure of which is incorporated herein by reference.

BACKGROUND

U.S. Pat. No. 11,504,572, which issued on Nov. 22, 2022, discloses an exercise bar assembly 10 shown in FIG. 1 that includes a pair of plate bar assemblies 11 that can be weighted and/or configure to receive conventional weight plates. The length of the plate bar assemblies 11 depends on the intended use of the bar assembly, and in particular the amount of weight expected to be carried by the bar assembly. Each plate bar assembly is fastened to a rotating mount assembly 24, and in particular to a rigid generally planar frame 26 of the mount. The frames of the two rotating mount assemblies 26 are connected to each other by a center bar assembly 15. The combination of the plate bar assemblies 11, center bar assembly 15 and the frames 26 form the barbell. Thus, the assembly of these components must be strong enough to support the weight carried by the plate bar assemblies 11 during use of the exercise bar assembly 10.

The center bar assembly 15 has a length that is sized to locate the rotating mount assemblies at an ideal location for the person to comfortably lift the bar assembly during a workout. Nominally, the person will grasp a conventional barbell with the hands roughly shoulder-width apart. Some weight-lifting exercises require the grip positions to be moved inboard or outboard. As described herein, the present disclosure contemplates that the center bar assembly can be provided in different lengths to provide different grip positions.

The rotating mount assemblies 24 support hand grips 22 for rotation in the plane of the frames 26. The hand grips 22 are conventionally sized to be comfortably grasped by the user. As described in more detail herein, a bearing assembly supports each of hand grips within its corresponding frame and permits smooth rotation of the grips relative to the frame. Each rotating mount assembly 24 includes a plurality of bearing posts 28*a*-28*f* projecting from one side of the mount, as shown in FIG. 1. In one feature of the bar assembly 10, an elastic band 30 includes a mounting collar 32 on each end that is adapted to be mounted on a bearing post on the two rotating mount assemblies 24. The elastic band spans between the two rotating grip assemblies 20 over the center bar assembly 15. The band passes through a gap formed between two fixed bearing posts 35 that are fixed to the frame 26 of each hand grip assembly 20.

As can be readily appreciated, the elastic band 30 provides elastic resistance to rotation of the hand grips 22 relative to the corresponding frames 26. In general terms, the elastic band successively engages the bearing posts 28*a*-28*f* as the hand grips are rotated, thereby providing continuous tension. More details of the use and operation of the bar assembly 10 can be found in the co-pending '412 application.

Further features of the exercise bar assembly 10 include a plurality of support posts 40 projecting from the top side of the frame 26 of each assembly, and a like plurality of posts 41 projecting from the bottom side of the frames. The support posts are sufficiently tall for the bar assembly to be supported on a surface, such as the floor, with clearance for the plate bar assemblies 11 and the bearing posts 22. The support posts 40, 41 allow a user to perform push-ups with the exercise bar assembly 10 sitting on the floor. In this respect, the bar assembly 10 works like a push-up disc known in the art. However, the elastic band 30 between rotating mount assemblies adds a feature not found in the conventional push-up discs.

In one embodiment, the exercise bar assembly 10 allows the rotating grip assemblies 20 to be separated by different distances to provide different grip locations and to accommodate the different anatomies of the users. In addition, different exercises require different grip locations, inside and outside shoulder-width, to work different muscle groups. Thus, in one aspect of the present disclosure, the center bar assembly 15 spanning the space between the two rotating handle assemblies 20 is modifiable. In particular, the center bar assembly 15 includes a center bar 45 (FIG. 2) that can be provided in different lengths. The user can select from among several center bars of different lengths to find a suitable grip width.

In order to maintain the versatility of the exercise bar assembly 10, a quick and simple means for replacing the center bar 45 is desirable.

SUMMARY OF THE DISCLOSURE

An exercise bar assembly comprises a pair of hand grip assemblies, each including a planar frame rotatably supporting a hand grip to be manually engaged by a user, and a pair of plate bar assemblies, one each engaged to one side of the frame each hand grip assembly, in which each of the plate bar assemblies is configured to support a weight. A center bar assembly is provided that removably connects the pair of hand grip assemblies, so that the user can select a particular length of center bar assembly for a particular spacing of the hand grip assemblies.

In one feature of the present disclosure, the center bar assembly includes an elongated center bar including a tubular portion at each end thereof, each tubular portion defining an interior cavity. At each end of the elongated center bar are a cylindrical collar engaged to the tubular portion, an elongated sleeve having an annular end wall and an opposite end engaged to the collar and defining an interior between the end wall and the opposite end, and a retaining washer disposed within the interior of the elongated sleeve, the retaining washer including an annular ring defining at the inner circumference at least one radial recess and at least one radial projection circumferentially adjacent the recess.

The exercise bar assembly further includes a mounting element fastened to the opposite side of the frame, that includes a flange fastened to the frame and an orientation stud projecting from the flange. The orientation stud includes an end configured to be received within the interior cavity of the center bar, and at least one shoulder projecting radially outward from the orientation stud. The at least one shoulder is sized for passage through the retaining washer only when the at least one recess is circumferentially aligned with the at least one shoulder, the at least one shoulder axially offset from the flange to define a corresponding circumferential channel between the at least one shoulder and the flange sized to receive the retaining washer therein. The washer is rotatable relative to the orientation stud to selectively align the at least one recess with the at least one shoulder and is axially movable along the orientation stud so that the washer can be moved toward the flange and then rotated into the circumferential channel corresponding to the at least one shoulder. The center bar assembly can thus be selectively engaged to each hand grip assembly by rotating the elongated sleeve and the retaining washer with it.

In another feature, a locking assembly is provided that prevents rotation of the washer and elongated sleeve when the mounting element if engaged to the center bar assembly. The locking assembly includes an axial pin that is movable into and out of a channel defined in the orientation stud. The pin is disposed within the channel to allow passage of the retaining washer over the orientation stud and is disposed within a radial recess of the retaining washer when the washer is disposed within the circumferential channel, thereby preventing rotation of the washer relative to the orientation stud and mounting element.

DETAILED DESCRIPTION

Figure 1:
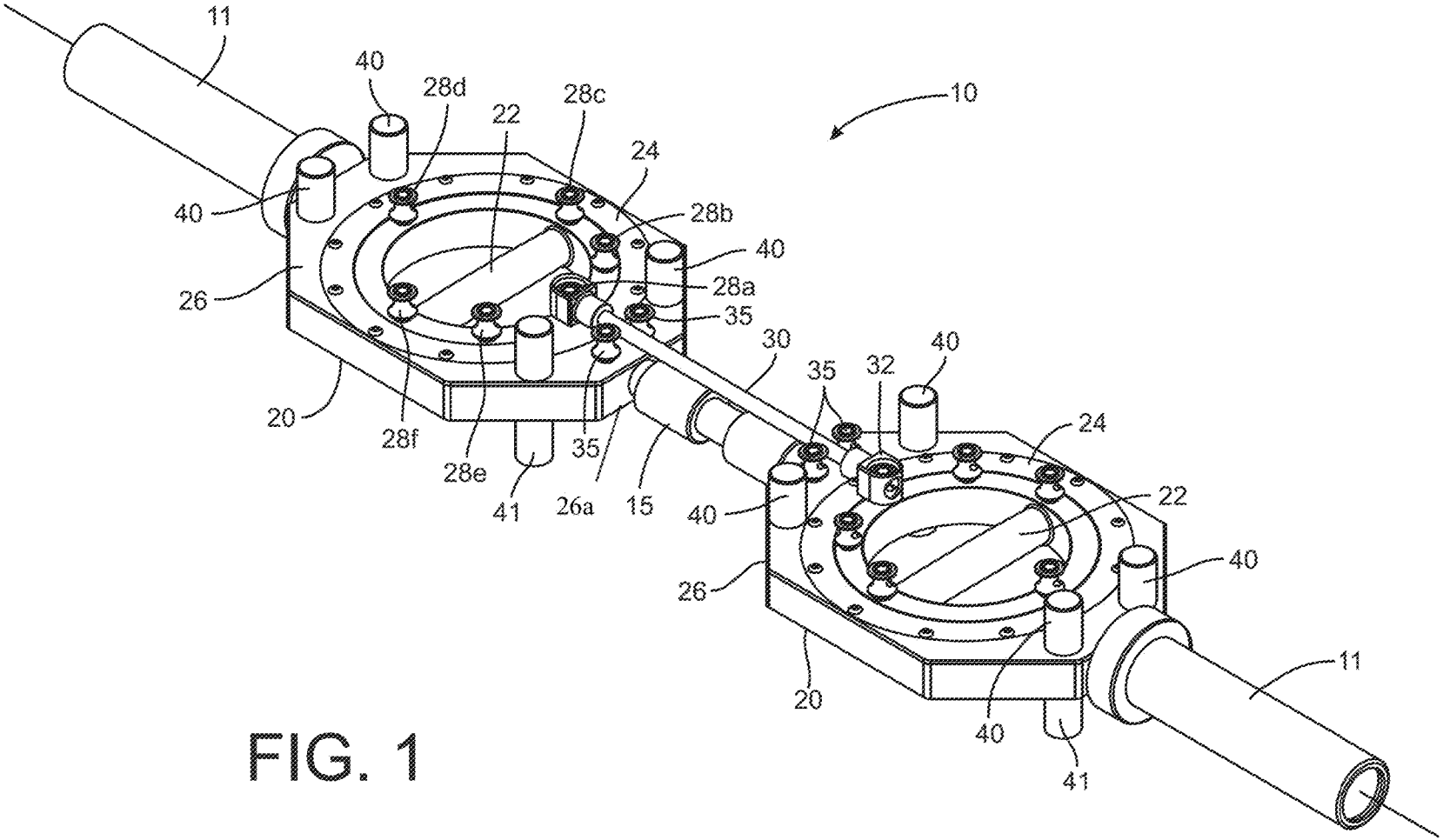
FIG. 1 is a perspective view of an exercise bar assembly incorporating the locking assembly of the present disclosure.

For the purposes of promoting an understanding of the principles of the disclosure, reference will now be made to the embodiments illustrated in the drawings and described in the following written specification. It is understood that no limitation to the scope of the disclosure is thereby intended. It is further understood that the present disclosure includes any alterations and modifications to the illustrated embodiments and includes further applications of the principles disclosed herein as would normally occur to one skilled in the art to which this disclosure pertains.

Figure 2:
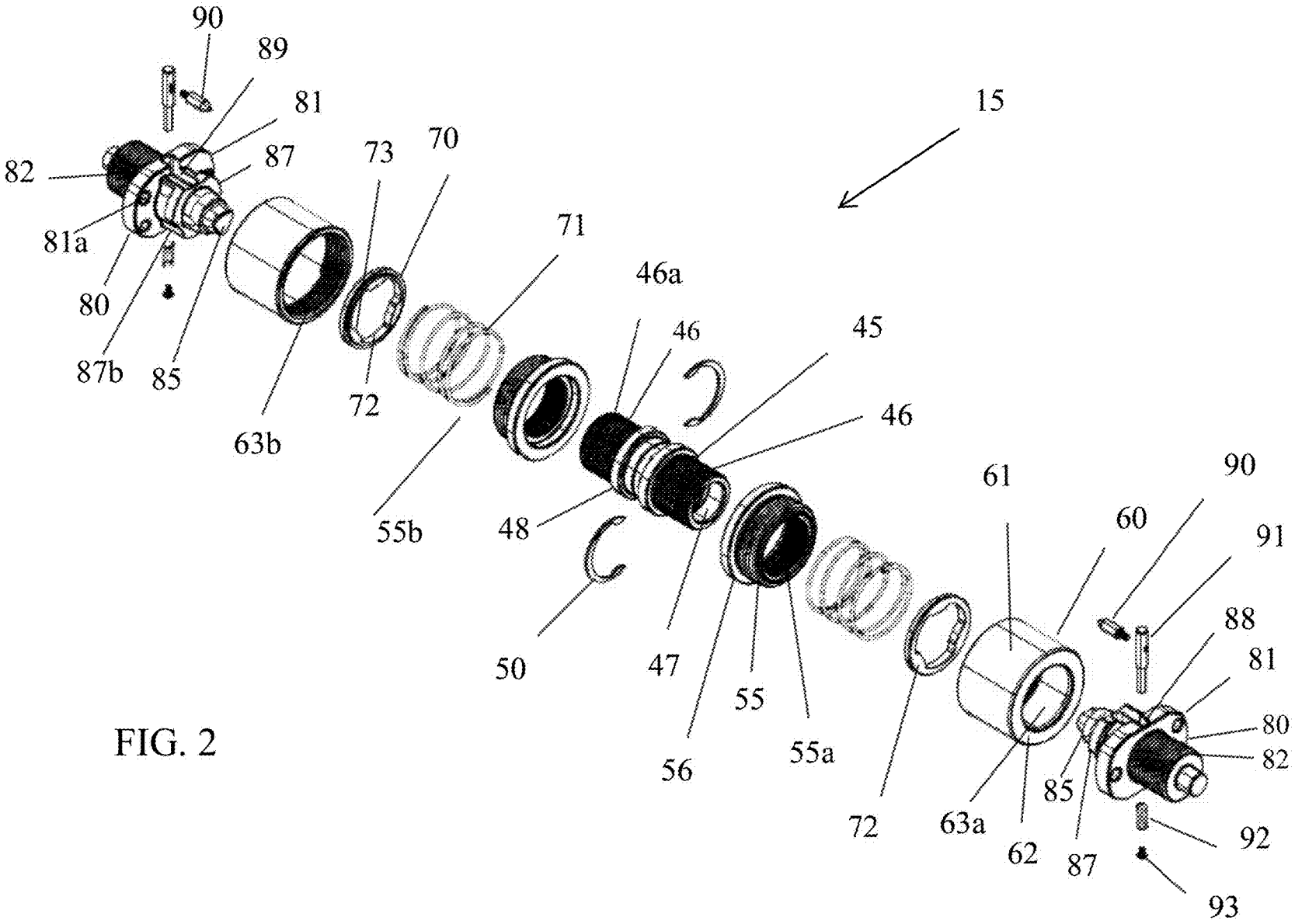
FIG. 2 is an exploded view of the center bar assembly of the exercise bar assembly shown in FIG. 1.
Figure 3:
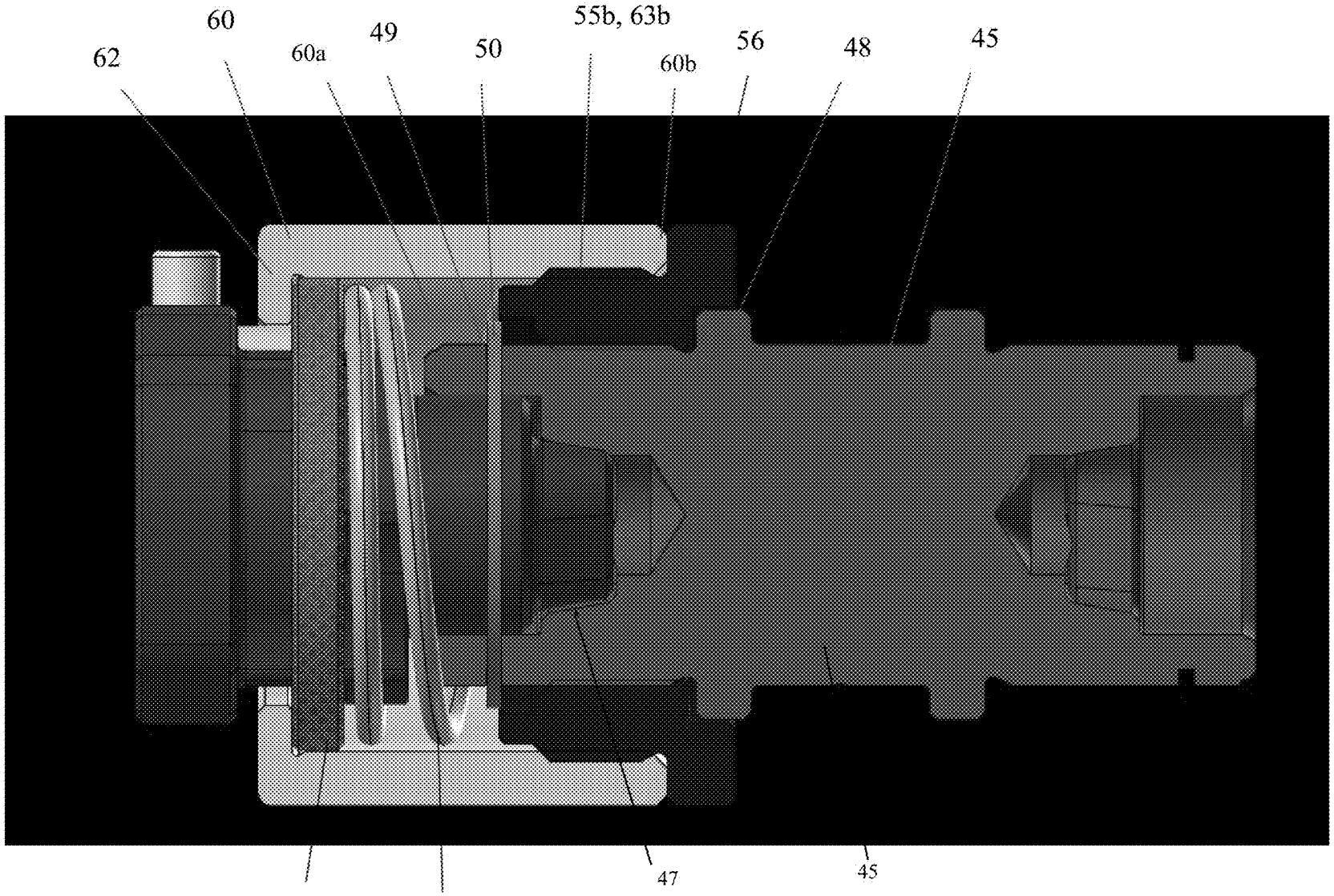
FIG. 3 is an enlarged cross-sectional view of the locking assembly according to one embodiment of the present disclosure.

A locking assembly is provided that allows easy removal and replacement of the center bar assembly 15, as shown in FIGS. 2-3. The center bar 45 includes opposite tubular portions 46 that include external threads 46*a* and an interior cavity 47. The interior cavity is trilobal, meaning that it forms a generally triangular shape to receive a mating component, as described below. The center bar includes a stop flange 48 associated with each of the tubular portions at the inboard end of the external threads. A snap ring groove 49 (see FIG. 3) is provided adjacent the free end of each tubular portion that is configured to receive an associated snap ring 50.

The locking assembly includes a collar 55 associated with each of the tubular portions 46 of the center bar 45. The collar includes internal threads 55*a* to mate with the external threads 46*a* of each end of the center bar. As shown in FIG. 3, the collar 55 is threaded onto one end of the center bar until the flange 56 of the collar contacts the stop flange 48 of the center bar. At this point, the snap ring 50 is engaged in the snap ring groove 49 to prevent the collar from unthreading from the center bar.

The locking assembly further includes a sleeve 60 having an exterior gripping surface 61 configured to be gripped by the user to rotate the sleeve. The outboard end of the sleeve 60—i.e., the end facing away from the collar 55—includes an annular end wall 62. The interior 60*a* of the sleeve is hollow from the end wall to the opposite inboard end 60*b* of the sleeve, with an outboard portion 63*a* being unthreaded and the inboard portion 63*b* being internally threaded to engage the external threads 55*b* of the collar 55. The sleeve 60 is configured to be threaded onto the collar 55 until the end of the sleeve contacts the flange 56 of the collar, as shown in FIG. 3.

Prior to threading the sleeve onto the collar, a retaining ring or washer 70 is placed within the sleeve to abut the interior of the annular end wall 62. A coil spring 71 is also introduced into the sleeve. As shown in FIG. 3, the retaining washer 70 and spring 71 are trapped between annular end wall 62 and the snap ring 50 or the end of the collar 56. It can be appreciated that the spring 71 reacts against the snap ring or collar to maintain pressure against the retaining washer 70, keeping it pressed against the annular end wall 62. More specifically, the spring 71 presses the washer against the end wall with sufficient force that friction between the two components causes the washer 70 to rotate with the sleeve 62.

Figure 4A:
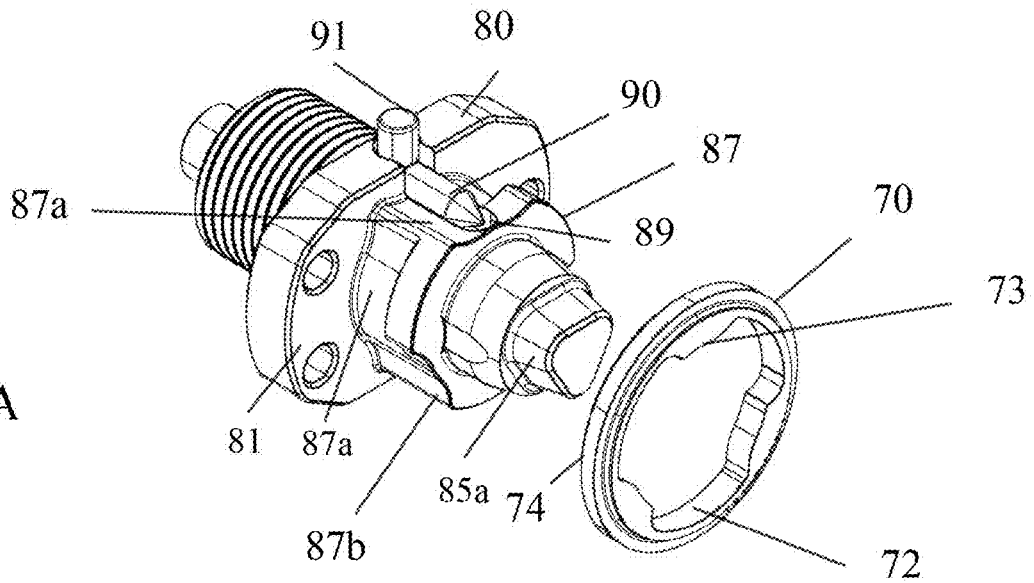
FIGS. 4A-4E are enlarged perspective views of the steps in the operation of a safety pin and a retaining washer of the locking assembly shown in FIG. 3.

As shown in FIG. 4A, the retaining washer is annular with an outer ring 74 sized for a close running fit within interior 60 of the sleeve. The face of the outer ring can be configured for a high-friction engagement with the end wall of the sleeve. The inner diameter of the outer ring 74 defines at least one radial recess 72 and at least one radial projection 73 circumferentially adjacent the recess. Preferably, the inner diameter defines three radial recess 72 and a radial projection 73 between each recess (for a total of three projections) that are circumferentially spaced at 120° intervals.

It should be understood that the center bar assembly 15 includes this stack of components extending from each end of the center bar 45. The sleeve 60 and retaining washer 70 are configured to permit releasable engagement to a mounting element 80 that is engaged to a respective rotating grip assembly 20 to complete the exercise bar assembly 10. The mounting element 80 includes a mounting flange 81 that abuts the face 26*a* of the frame 26 of the grip assembly (see FIG. 1). A threaded post 82 projects from the mounting flange to be threaded into a corresponding threaded bore in the frame 26. The flange 81 can also include bores 81*a* to receive dowels 101 that are configured to be press-fit into bores 26*b* in the frame 26 (see FIG. 5).

The mounting element further includes an orientation stud 85 projecting outward from the flange 81, which includes a trilobal tapered end 85*a*. The tapered end 85*a* is complementary with the trilobal interior cavity 47 of the center bar 45. The orientation stud 85 is thus configured to engage the center bar and to prevent relative rotation between the two components. The orientation stud defines three shoulders 87 that are sized and shaped to be received within the recess 72 defined between the projections 73 in the retaining washer 70 (see FIG. 4A). The projections 73 are sized and configured to be held between the flange 81 and the shoulders 87 when the retaining washer 70 is rotated about the orientation stud. The shoulders 87 are axially offset along said orientation stud from said flange 80 to define a circumferential channel 87*a* between each shoulder and the flange.

The mounting element 80 includes a safety pin 90 that is mounted to a post 91 that is slidably disposed within a bore 88 in the flange 81 (see FIG. 2). The post 91 is upwardly biased by a spring 92 held within the bore 88 by a closing cap 93. The orientation stud 85 defines a channel 89 projecting perpendicularly from the flange 81 and intersecting the bore 88. The channel 89 is arranged between two of the shoulders 87. The safety pin 90 is received within the channel 89 when the post 91 is depressed against the spring. The safety pin operates to lock the retaining washer 70 in its rotated position in the circumferential channel 87*a* behind the shoulders 87, as best depicted in FIGS. 4A-E. (The mounting element 80 is depicted unconnected to the frame of the grip assembly and the retaining washer 70 is shown separate from the locking assembly for clarity.) It is understood that the retaining washer 70 is rotated by the sleeve 60 under manual rotation. In the initial condition of the mounting element 80, shown in FIG. 4A, the safety pin 90 is pushed upward by the spring-biased post 91 so that the pin 90 is situated above, and not within, the channel 89. In this position, the retaining washer 70 cannot be mounted onto the mounting element 80 because the safety pin 90 interferes with the annular outer ring 74 of the retaining washer 70.

Figure 4B:
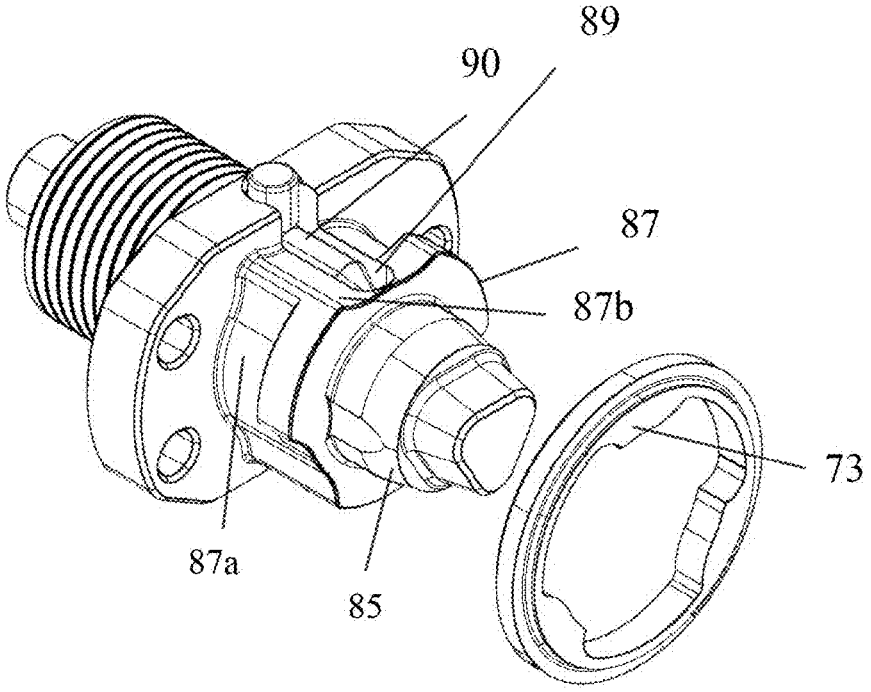

In FIG. 4B, the post 91 is depressed to push the safety pin 90 into the channel 89. The retaining washer 70 is oriented so that a projection 73 is aligned with the safety pin 90, and more particularly with a gap 87*b* between adjacent shoulders 87 of the mounting element.

Figure 4C:
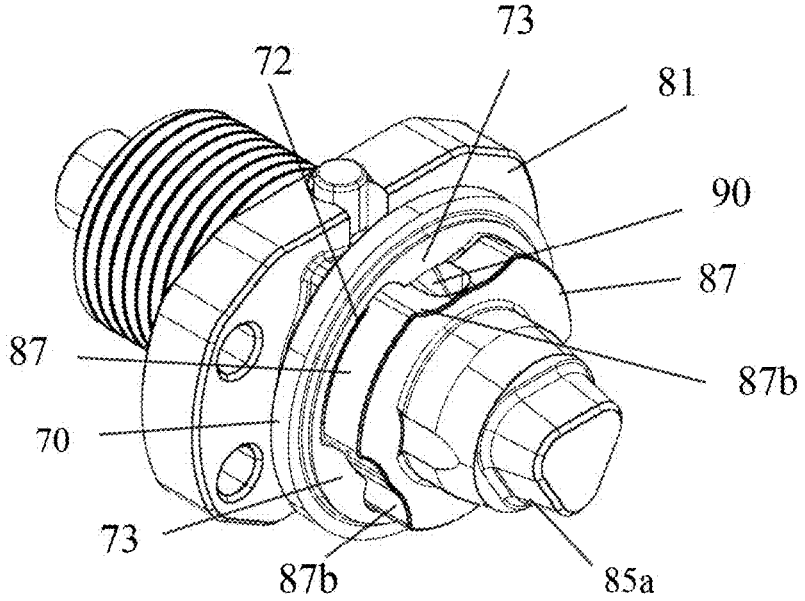
Figure 4D:
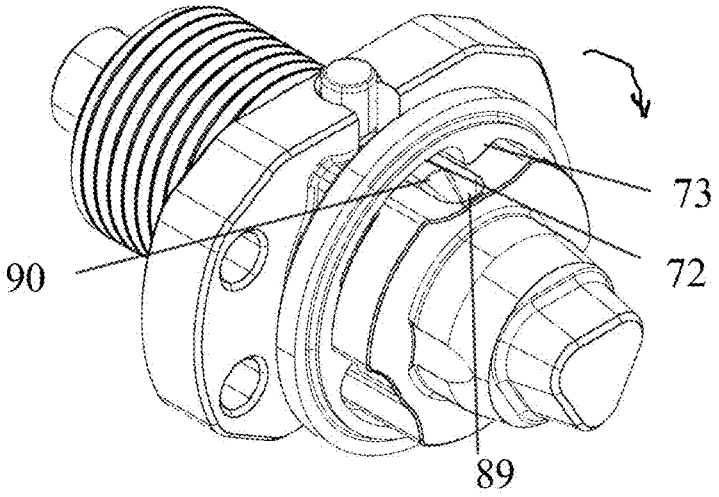
Figure 4E:
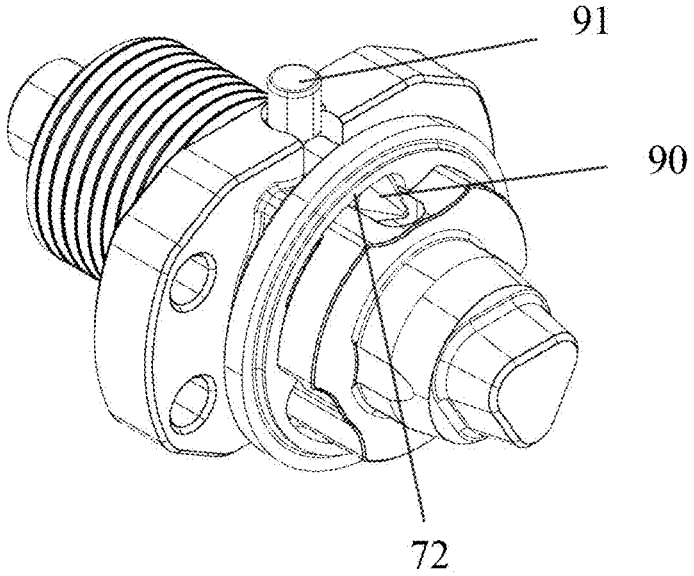

As shown in FIG. 4C, the retaining washer 70 is advanced over the mounting element 80, or more particularly the mounting element 80 is moved through the washer 70 so that the orientation stud 85 enters the interior cavity 47 of the center bar 45, as shown in FIG. 3. This movement requires that the recesses 72 of the washer are aligned with the shoulders 87 and that the projections 73 are aligned with the gaps 87*b* of the mounting element. The safety pin 90 is still depressed within the channel 89 so that the retaining washer 70 can be pushed fully onto the mounting element against the flange 81, as shown in FIG. 4D. In this position, the retaining washer 70 can be rotated in either direction (although clockwise is depicted in FIG. 4D) until a recess 72 is aligned with the channel 89 and with the safety pin 90. The projections 73 are then positioned behind the shoulders 87 thereby locking the axial position of the retaining washer in the circumferential channel 87*a* between the shoulders 87 and the flange 81 of the mounting element 80. In this position, the spring-biasing of the post 91 pushes the safety pin 90 upward, out of the channel 89 and into the recess 72 in the retaining washer, as shown in FIG. 4E. The retaining washer is thus prevented from rotation by the safety pin, and is thus retained in its locked position behind the shoulders 87.

The mounting element 80 can be disengaged from the retaining washer 70, and thus from the center bar 45, by first depressing the post 91 to push the safety pin 90 into the channel 89. The retaining washer can be rotated by manually rotating the sleeve 60 until a projection 73 aligns with the safety pin 90, so that the projection effectively holds the pin 90 in the recess 89 while the mounting element 80 is moved axially away from the interior cavity 47 to disengage from the center bar 45.

Figure 5:
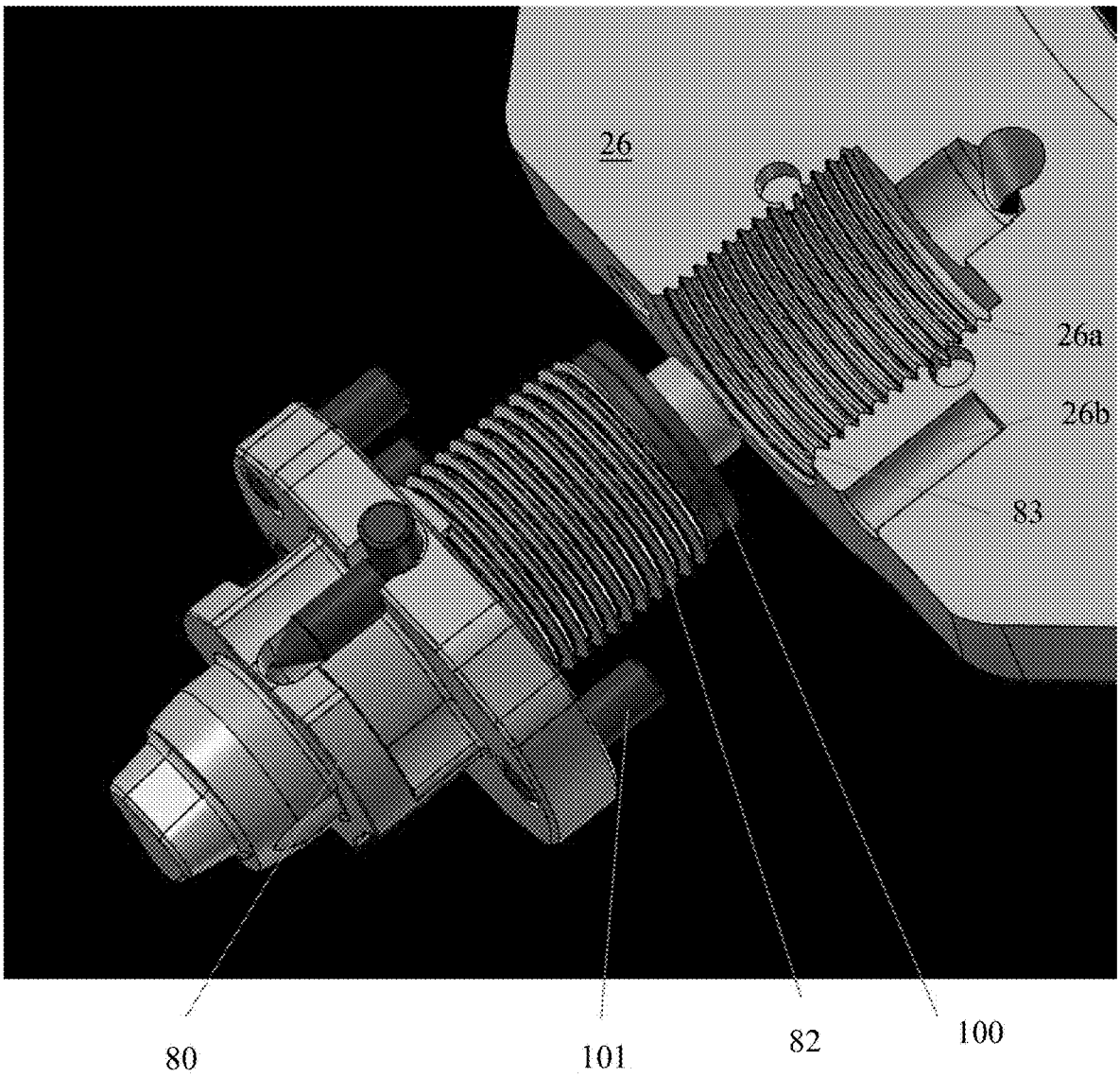
FIG. 5 is an enlarged perspective view of biasing springs with a threaded post of the locking assembly shown in FIG. 3.

Another feature of the mounting element 80 is shown in FIG. 5. The mounting element 80 includes the threaded post 82 for threading into a threaded bore 26*a* of the frame 26. A stud 83 projects axially from the threaded post to receive a pair of Belleville springs 100. The springs are compressed when the threaded post 82 is fully threaded within the bore 26*a*. In one embodiment, the Belleville springs can have a 0.040 in. spring load at approximately 2500 psi. The springs thus provide a continuous load on the threaded post to keep the center bar from accidentally dislocating from the frames 26.

The present disclosure should be considered as illustrative and not restrictive in character. It is understood that only certain embodiments have been presented and that all changes, modifications and further applications that come within the spirit of the disclosure are desired to be protected.

What is claimed is:

1. An exercise bar assembly comprising:

a pair of hand grip assemblies, each including a planar frame rotatably supporting a hand grip to be manually engaged by a user;

a pair of plate bar assemblies, one each engaged to one side of said frame of a corresponding one of said pair of hand grip assemblies, each of said plate bar assemblies configured to support a weight; and a center bar assembly having opposite ends, each of said opposite ends removably engaged to a corresponding one of said pair of plate bar assemblies on an opposite side of said frame opposite a corresponding one of said pair of hand grip assemblies, said center bar assembly including;

an elongated center bar including a tubular portion at each end thereof, each tubular portion defining an interior cavity open at a corresponding one of said opposite ends of said center bar assembly, and at each end of said elongated center bar;

a cylindrical collar engaged to said tubular portion;

an elongated sleeve having an annular end wall and an opposite end engaged to said collar and defining an interior between said end wall and said opposite end; and a retaining washer disposed within said interior of said elongated sleeve, said retaining washer including an annular ring defining at the inner circumference at least one radial recess and at least one radial projection circumferentially adjacent said recess; and a mounting element fastened to said opposite side of said frame, said mounting element including;

a flange fastened to said frame;

an orientation stud projecting from said flange and including;

an end configured to be received within the interior cavity of said center bar; and at least one shoulder projecting radially outward from said orientation stud, said at least one shoulder sized for passage through said retaining washer only when said at least one recess is circumferentially aligned with said at least one shoulder, said at least one shoulder axially offset from said flange to define a corresponding circumferential channel between said at least one shoulder and said flange sized to receive said retaining washer therein, wherein said washer is rotatable relative to said orientation stud to selectively align said at least one recess with said at least one shoulder and is axially movable along said orientation stud so that said washer can be moved toward said flange and then rotated into the circumferential channel corresponding to said at least one shoulder.

2. The exercise bar assembly of claim 1, wherein a spring is disposed within said interior of said elongated sleeve between said retaining washer and said cylindrical collar to bias said retaining washer against said end wall of said elongated sleeve so that said retaining washer rotates with said elongated sleeve when the sleeve is rotated.

3. The exercise bar assembly of claim 1, wherein:

said orientation stud defines an axial channel extending from said flange and adjacent one shoulder of said at least one shoulder; and said mounting element further includes a locking pin aligned with said axial channel and supported by said flange of said mounting element for radial movement relative to said orientation stud so that said locking pin can be selectively disposed within said axial channel.

4. The exercise bar assembly of claim 3, wherein said flange defines a radial bore intersecting said axial channel, said locking pin includes a perpendicular post disposed within said radial bore, said post slidable within said radial bore to move said locking pin into and out of said axial channel.

5. The exercise bar assembly of claim 4, further comprising a spring disposed within said radial bore and arranged to bias said post radially outward from said flange.

6. The exercise bar assembly of claim 1, further comprising a threaded engagement between said collar and tubular portion.

7. The exercise bar assembly of claim 1, further comprising a threaded engagement between said elongated sleeve and said collar.

8. The exercise bar assembly of claim 1, wherein said interior cavity and said end of orientation stud are trilobal.

9. The exercise bar assembly of claim 1, wherein said retaining washer includes three radial recesses and projections spaced at 120° intervals; and said orientation stud includes three shoulders corresponding to said three radial recesses.

10. The exercise bar assembly of claim 1, wherein:

said frame of each of said pair of hand grip assemblies defines a threaded bore on said opposite side; and said flange of said mounting element includes a threaded post fastened to said frame extending axially opposite said orientation stud, said threaded post configured to threadedly engage said threaded bore of said frame, wherein said exercise bar assembly further includes a Belleville spring received within said threaded bore between said frame and said threaded post.

* * * * *